US006142385A

United States Patent [19]

Tacoma

[11] Patent Number: 6,142,385

[45] Date of Patent: Nov. 7, 2000

[54] PARTICLE BLAST NOZZLE APPARATUS AND METHOD

[76] Inventor: Michael T. Tacoma, N14187 County Rd. K, Clear Lake, Wis. 54005

[21] Appl. No.: 09/234,244

[22] Filed: Jan. 20, 1999

Related U.S. Application Data

[60] Provisional application No. 60/071,967, Jan. 20, 1998.

[51] Int. Cl.[7] ..... B67D 5/08; B24C 5/04

[52] U.S. Cl. ..... 239/71; 451/102

[58] Field of Search ..... 239/591, 71, 589; 116/208; 451/102, 38, 90

[56] References Cited

U.S. PATENT DOCUMENTS

| | | | |
|---|---|---|---|
| 2,532,655 | 12/1950 | Backer | 451/102 |
| 2,801,133 | 7/1957 | Ridley | 239/591 |
| 3,111,179 | 11/1963 | Albers et al. | 239/591 |
| 3,545,679 | 12/1970 | McAllister | 239/591 |
| 4,241,878 | 12/1980 | Underwood | 239/591 |
| 4,300,723 | 11/1981 | Prasthofer | 239/589 |
| 4,817,701 | 4/1989 | Stevens | 164/415 |
| 5,036,631 | 8/1991 | Stoltz | 451/102 |

*Primary Examiner*—Andres Kashnikow
*Assistant Examiner*—Davis Hwu
*Attorney, Agent, or Firm*—Skinner and Associates

[57] ABSTRACT

An improved nozzle for a gun or output means of a particle blast apparatus such as a sand blast cleaning device. The nozzle has a wear indicating lip that clearly and unambiguously shows the operator when the nozzle has reached the end of its useful life and should be replaced. The nozzle is elongated and tapered to improve power and accuracy. The nozzle has a proximal media inlet end which has a predetermined configuration which maximizes media/air mixing and flow, and minimizes turbulence and nozzle/gun interface wear. The invention also provides a method of using a particle blast apparatus, and particularly for determining when a nozzle has worn and should be replaced.

3 Claims, 5 Drawing Sheets

PARTICLE BLAST NOZZLE APPARATUS AND METHOD

This application claims the benefit under 35 U.S.C. §119(e) of copending provisional application Ser. No. 60/071,967 filed Jan. 20, 1998.

BACKGROUND OF THE INVENTION

1. Field of the Invention

The present invention relates, generally, to nozzles. More particularly, the invention relates to nozzles for particle blasting apparatus using sand, glass and/or other blast media.

2. Background Information

The state of the art includes various blasting guns and nozzles. Blasting is used in a variety of industries for a variety of purposes. One use is to clean and/or peen components of aircraft.

Prior art devices and methods are believed to have significant limitations and shortcomings. Specifically, prior art nozzle devices lack an optimum means of detecting when they have worn to a point where they should be replaced. Prior art nozzles also lack an optimum mixing inlet. Prior art nozzles, which tend to be short and blunt, are difficult and imprecise to aim. These shortcomings result in devices which work less than optimally when new, which perform still less optimally as they are used, and which continue to be used long after their intended lifespan has ended.

The present invention provides a nozzle for a media blasting gun which is believed to constitute an improvement over the prior art.

BRIEF SUMMARY OF THE INVENTION

The present invention provides an improved nozzle for a gun or output means of a particle blast apparatus such as a sand blast cleaning device.

The invention specifically provides:

1. A nozzle comprising a body of a predetermined thickness, a central bore in the body having a predetermined outer dimension, and a lip disposed on the body and being coextensively with the bore, the lip having a predetermined thickness which is less than that of the body.

2. A nozzle comprising a body, a central bore in the body defining an inlet end and an outlet end, the inlet end having a predetermined convex wall configuration.

3. A nozzle comprising a body with a central bore therethrough defining an inlet end and an outlet end of the body, the body having a at least one portion having a tapered configuration.

4. A method of using a replaceable nozzle with a media/air mixing unit, comprising the steps of:

(a) providing a nozzle including a body of a predetermined thickness, a central bore in the body having a predetermined outer dimension, and a lip disposed on the body and being coextensively with the bore, the lip having a predetermined thickness which is less than that of the body;

(b) connecting the nozzle to a media/air mixing unit;

(c) operating the media/air mixing unit, whereby a media/air mixture has an abrasive action on the bore of the nozzle increasing its diameter; and (d) observing the lip and determining when the lip disintegrates, thereby indicating that the nozzle should be replaced.

The nozzle has a wear indicating means that clearly and unambiguously shows the operator when the nozzle has reached the end of its useful life and should be replaced.

The Nozzle has an proximal or media inlet end which has a predetermined configuration which permits maximizes media/air mixing and flow, and minimizes turbulence and nozzle/gun interface wear.

The invention also provides a method of using a particle blast apparatus, and particularly for determining when a nozzle has worn and should be replaced.

The features, benefits and objects of this invention will become clear to those skilled in the art by reference to the following description, claim(s), if any, and drawings.

DETAILED DESCRIPTION

Figure 1:
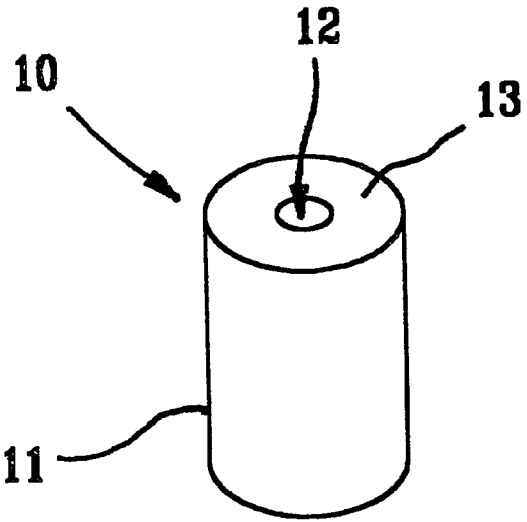
FIG. 1 PRIOR ART
FIG. 1 is a front view of a prior art nozzle for a particle blasting apparatus.
Figure 2:
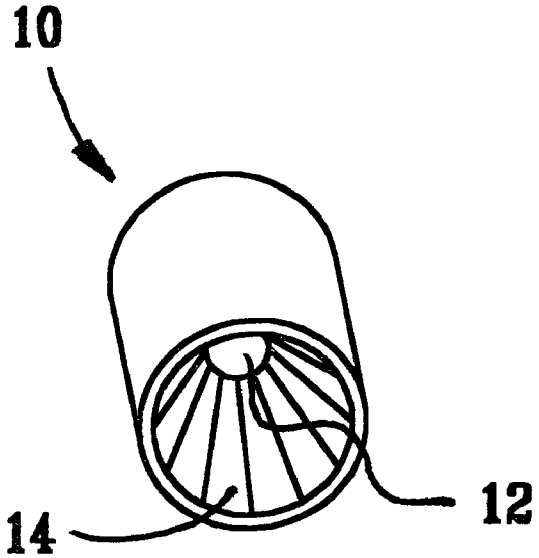
FIG. 2 PRIOR ART
FIG. 2 is a bottom perspective view of the prior art nozzle.

Referring to FIGS. 1, 2 and 13, prior art particle blast apparatus nozzles 10 and 20 are shown. Nozzle 10 is constructed of a ceramic material and has a cylindrical body 11 with a central, transaxial bore 12. The distal or outward output end 13 of the nozzle 10 is flat. The proximal end of the nozzle 10 has a concave counter-bore 14 located centrally and inset a predetermined distance from the outer periphery of the end forming a shoulder. Nozzle 20 is constructed of a metallic material and has a cylindrical body 21. It also has a distal end 22 which is flat. A circumferential notch 23 of a certain depth is disposed in the body 21.

Figure 3:
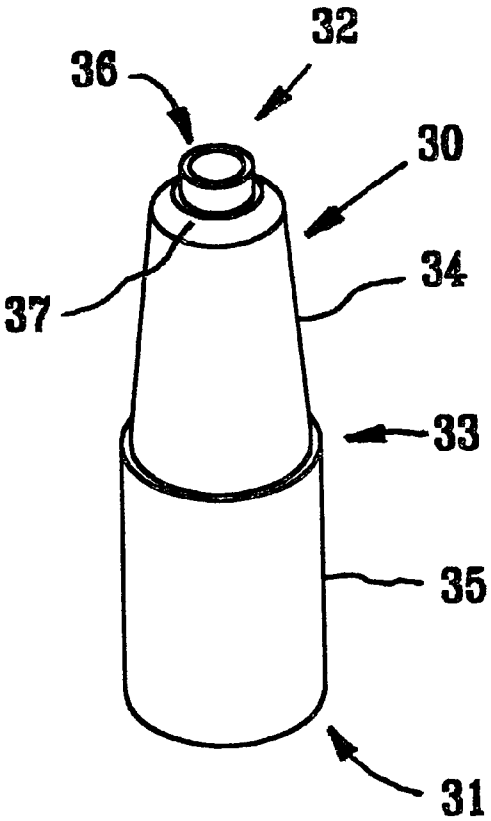
FIG. 3 is a front view of the particle blasting nozzle of the present invention.
Figure 4:
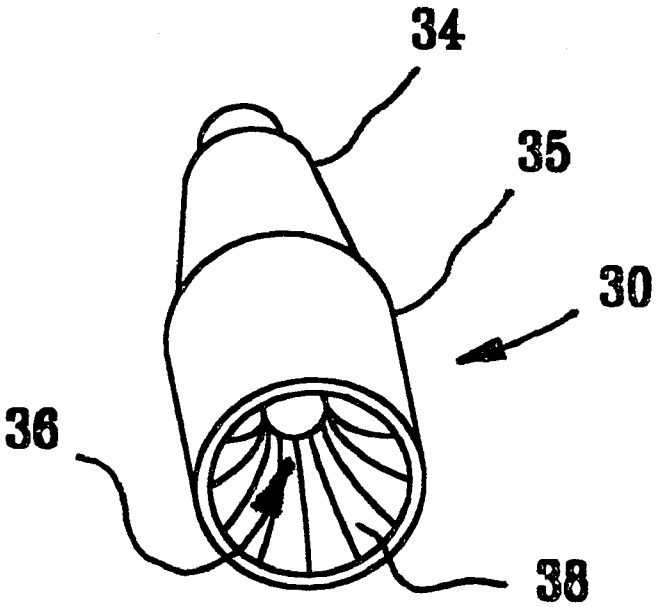
FIG. 4 is a bottom perspective view of the nozzle of this invention.
Figure 5:
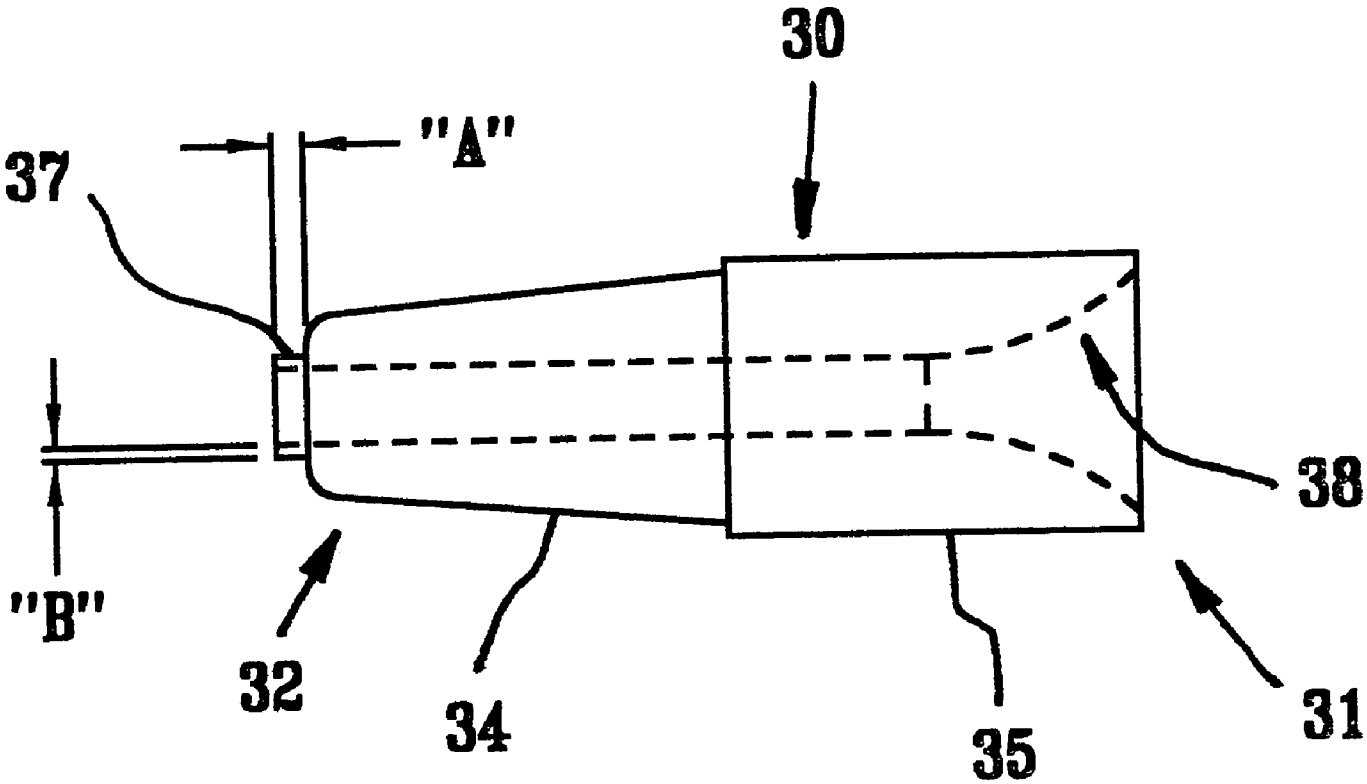
FIG. 5 is a side view of the nozzle, showing the interior bore in phantom.
Figures 6, 7, 8, 9, 10:
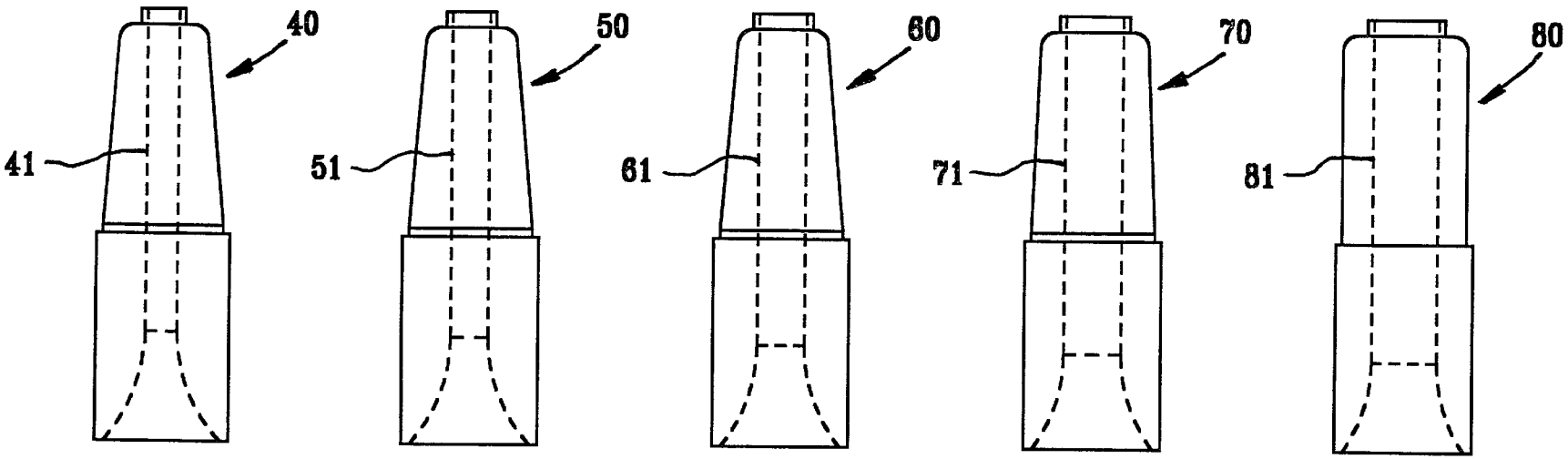
FIGS. 6–10 shown exemplary bore sizes of the nozzle.

Referring to FIGS. 3–5, the particle blast nozzle 30 of the present invention has a proximal input end 31 and a distal output end 32. It has a generally cylindrical body 33 which has a predetermined length. The body 33 is preferably constructed of a high density, high grade ceramic material which is formed by an extrusion process. The body 33 is relatively long and has a proximal portion 35 of a uniform predetermined length and diameter, and a distal portion 34 of a predetermined length extending outwardly with respect to the proximal portion 35. The distal portion has a predetermined taper which, in combination with the length of the body 33, makes it easy to aim and more accurate. A central, transaxial bore 36, which is also relatively long due to the extended body 33 length, extends through the body 33. This long body 33 and long bore 36 permits the media to achieve the same speed as the air throughput and thereby increases the use life of the nozzle 30 (due to decreased bore 36 wear) and to increase the velocity of the media throughput per volume of air (thereby increasing power without a corresponding increase in consumption of air).

A wear indicating lip or ring 37 is disposed at the distal end of the nozzle 30. The lip 37 is preferably formed integrally with the body 33. As is best shown in FIG. 5, the lip 37 has a predetermined height "A" and a predetermined thickness "B". The lip 37 is disposed about the periphery of the bore 36 such that the interior wall of the lip 37 is integral with the outer wall of the bore 36. The lip 37 is preferably dyed, painted or other wise colored with a pigment. The color is preferably a bright, visible, easily seen color such as red, yellow or the like. The interior of the ceramic bore 36 wears as fast moving and abrasive media particles impact its sides. As a result, the inner diameter of the bore 36 increases and the body 33 wall thickness decreases. As the lip 37 structure has an inner wall which is coextensive with that of the bore 36, it also wears. In use, the lip 37 is worn by the media and gradually disappears. As the lip 37 has a predetermined thickness "B", it functions as wear indicating means that clearly and unambiguously shows the operator when bore 36 wear has reached a predetermined point whereby the nozzle has reached the end of its useful life and should be replaced. It is difficult for operator to determine whether and when prior art design nozzles have worn to a point where they should be replaced. Worn nozzles are less powerful, less productive (at cleaning or peening surfaces for example) and use media less efficiently.

The proximal end 31 of the body 33 has a curvilinear, funnel shaped entry portion 38 with a convex wall portion. The entry funnel portion 38 extends from the proximal end 31 and merges with the bore 36. This bugle or trumpet-type configuration of the proximal or media inlet provides a smooth entry for a venturi shape in the nozzle which accelerates media velocity, maximizes media/air mixing and flow, and minimizes turbulence and nozzle/gun interface wear in conjunction with the gun structure and function which is discussed further below. The structure provides improved suction and power, particularly at lower air pressures.

FIGS. 6–10 show varying bore 41, 51, 61, 71, and 81 diameters for nozzles 40, 50, 60, 70 and 80.

Figure 11:
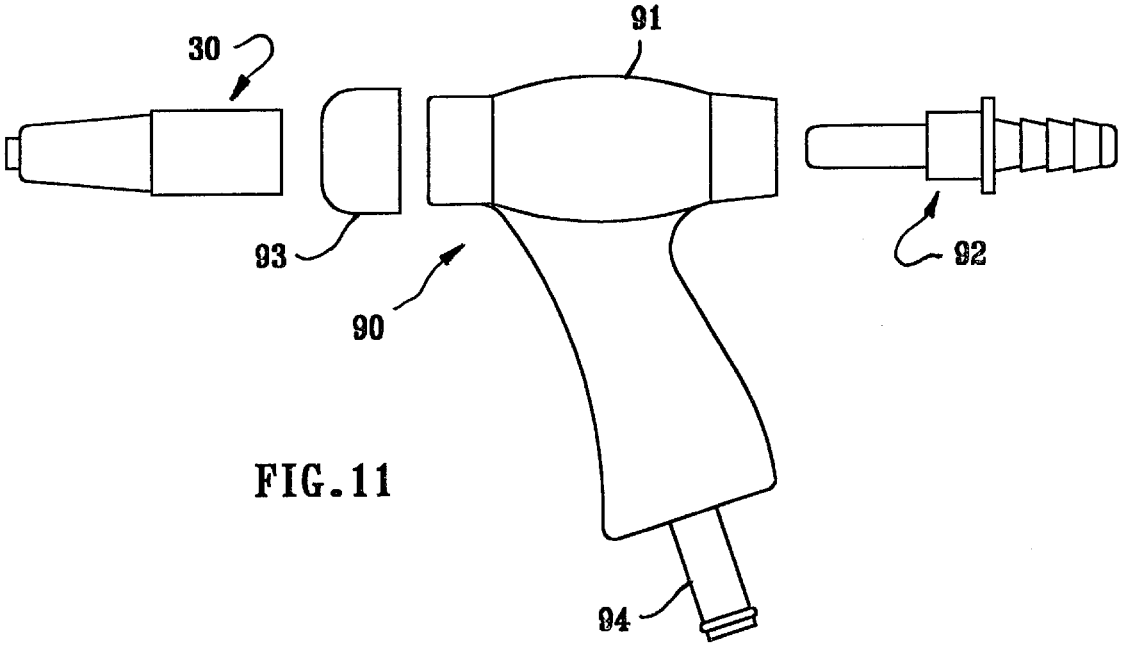
FIG. 11 illustrates the nozzle in cooperation with a particle blast apparatus gun, shown partially exploded for clarity.
Figure 12:
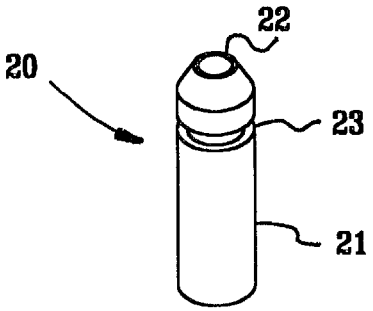
FIG.12 PRIOR ART
FIG. 12 is a front view of another prior art nozzle.

FIGS. 11 and 12 illustrate the nozzle 30 of the present invention cooperatively associated with an operator guided output means 90 of a particle blast apparatus, commonly known as a "gun". In general, the gun 90 comprises a body 91, an air jet assembly 92, a nozzle retaining nut 93 and a particle media inlet 94.

The body 91 is preferably formed of cast aluminum (hardened). It has an ergonomic shape with an internal chamber 95. The air jet assembly 92 is aligned and cooperates with the nozzle entry 38 to provide high suction pressures for optimal blasting function.

The descriptions above and the accompanying materials should be interpreted in the illustrative and not the limited sense. While the invention has been disclosed in connection with the preferred embodiment or embodiments thereof, it should be understood that there may be other embodiments which fall within the scope of the invention.

The invention claimed is:

1. A nozzle for use with an abrasive media/air mixing unit, comprising a body of a predetermined thickness, a central bore in the body having a predetermined diameter, and a lip formed with the body and being coextensive with the bore, the lip having a predetermined thickness which is less than the thickness of the body, whereby during use of the nozzle, lip disintegrates to indicate that the nozzle should be replaced.

2. An abrasive media/air mixing unit, comprising a gun structure and a nozzle, the nozzle comprising a body, a central bore in the body having a predetermined diameter, and a lip formed with the body and being coextensive with the bore, the lip having a predetermined thickness which is less than the thickness of the body, whereby during use of the unit, the lip disintegrates to indicate that the nozzle should be replaced.

3. A method of using a replaceable nozzle with a media/air mixing unit, comprising the steps of:

(a) providing a nozzle including a body of a predetermined thickness, a central bore in the body having a predetermined diameter, and a lip disposed on the body and being coextensive with the bore, the lip having a predetermined thickness which is less than that of the body;

(b) connecting the nozzle to a media/air mixing unit;

(c) operating the media/air mixing unit, whereby a media/air mixture has an abrasive action on the bore of the nozzle increasing its diameter; and (d) observing the lip and determining when the lip disintegrates, thereby indicating that the nozzle should be replaced.

* * * * *